US007699388B2

(12) United States Patent
Figueras Mitjans

(10) Patent No.: US 7,699,388 B2
(45) Date of Patent: Apr. 20, 2010

(54) SEATING INSTALLATION CONCEALABLE UNDER THE FLOOR

(75) Inventor: Jose Figueras Mitjans, Llica D'Amunt (ES)

(73) Assignee: Figueras International Seating S.A., Llica D'Amunt (Barcelona) (ES)

( * ) Notice: Subject to any disclaimer, the term of this patent is extended or adjusted under 35 U.S.C. 154(b) by 0 days.

(21) Appl. No.: 12/168,262

(22) Filed: Jul. 7, 2008

(65) Prior Publication Data

US 2009/0212612 A1 Aug. 27, 2009

(30) Foreign Application Priority Data

Feb. 22, 2008 (ES) ..... 200800496

(51) Int. Cl.
*A47C 9/06* (2006.01)

(52) U.S. Cl. ..... 297/15

(58) Field of Classification Search ..... 297/15, 297/14, 331, 334, 335; 296/66; 52/8, 9
See application file for complete search history.

(56) References Cited

U.S. PATENT DOCUMENTS

| | | | | |
|---|---|---|---|---|
| 5,195,795 | A * | 3/1993 | Cannera et al. | 296/65.09 |
| 6,983,985 | B2 * | 1/2006 | McGowan et al. | 297/15 |
| 7,240,950 | B2 * | 7/2007 | Fourrey et al. | 296/66 |
| 7,484,785 | B2 * | 2/2009 | Weber | 296/65.05 |
| 2001/0054835 | A1 * | 12/2001 | Feng | 297/232 |
| 2008/0303305 | A1 * | 12/2008 | Day | 296/66 |

* cited by examiner

*Primary Examiner*—Milton Nelson, Jr.
(74) *Attorney, Agent, or Firm*—Lucas & Mercanti, LLP

(57) ABSTRACT

A seating installation, which is concealable under the floor. The seats are mounted in articulated manner, with the possibility of swiveling between a lowered, cleared-away position and a raised position of use, on pillars which are fixed to the base floor. A number of flaps are mounted in articulated manner on the same pillars forming a raised access floor under which the seats may be concealed in the lowered position.

7 Claims, 11 Drawing Sheets

SEATING INSTALLATION CONCEALABLE UNDER THE FLOOR

FIELD OF THE INVENTION

The present invention relates to the installation of seats in enclosed spaces, such as performance spaces, sports halls, etc., where the option is needed to be able to change the seating arrangements, such that the seats may be arranged, wholly or in part, in a position of use on the floor of the enclosed space or in a concealed position such that the surface of the floor is clear.

BACKGROUND OF THE INVENTION

In enclosed spaces which include seating installations which it would be useful to be able to arrange in a position of use or to remove so that the enclosed space is partially or totally clear, solutions are already known in which the seats are stowed away under a raised access floor.

The existing solutions of this type are nonetheless of very complex configuration and require a cavity or pit of considerable height underneath the raised access floor, which makes it necessary to reduce the useful height of the enclosed space. In addition, to support the raised access floor structures are required which increase costs considerably.

OBJECT OF THE INVENTION

The invention proposes an installation which enables the seats in an enclosed space to be cleared away in a position under the floor where they take up only a little height, so advantageously overcoming the disadvantages of the conventional installations used in this way.

With the installation according to the invention, low pillars are arranged over the base floor of the enclosed space in which it is to be used, there being fitted on said pillars swivellably mounted seat assemblies and, in turn, also swivellably mounted covering flaps, by means of which a raised access floor is formed, underneath which the seat assemblies may be concealed in a lowered position.

The seat assemblies are preferably arranged on a load-bearing structural beam, which is connected to a number of pillars of the installation by means of respective arms articulated thereto with the possibility of swivelling, with manual or motorised actuation, between a raised seat position and a lowered seat position, cylinders of gas being provided to assist in the swivelling movements and to prevent abrupt shocks.

Furthermore, each seat assembly has one or more locking devices, by means of which the seats are locked in the raised position, all the locking devices of each seat assembly being connected for simultaneous unlocking actuation thereof to lower the seats.

Articulation of the arms of the seat assembly support structure to the pillars of the installation is achieved with an arrangement which is displaced laterally with regard to the longitudinal axis of said arms, this resulting, upon lowering of the seat assemblies, in a position which allows the system to be compact with minimal space between the rows of seats as well as enabling the seat assemblies to be lowered into a position which allows the covering raised access floor to be at the lowest possible height.

The flaps which cover the seats when concealed in the lowered position are in turn articulated to the pillars of the installation, said flaps having a number of independent parts fixed to the mounting pillars, in association with which fixed parts said flaps form a number of recesses which enable swivelling between a raised position and a lowered position of the above-mentioned flaps, while the fixed parts in turn have a zone capable of swivelling, which zone allows passage of the arms providing swivelling mounting of the corresponding seat assembly for swivelling said assembly into the raised position.

In the lowered position the covering flaps together form a raised access floor, through which may extend the arms of the support structure for the seat assemblies in the raised position, said flaps forming a free, clear surface when the seat assemblies are lowered into the stowed position underneath, wherein the successive flaps may be continuously flush, if the installation is mounted on level floors, or indeed staggered to form a stepped surface, if the installation is mounted on inclined floors.

Furthermore, seat assemblies mounted swivellingly on the associated pillars, and the respective covering flaps, may be arranged in modular blocks capable of being mounted as a whole in the installations used, wherein said modular blocks may be incorporated into raised structures, so that the seats may be situated at selected heights for use, for example to form tiers of stepped seats.

In any case, swivelling of the seat assemblies and of the flaps that make up the raised access floor between their respective lowered and raised positions may be brought about by manual actuation, but automatic actuation may also be provided, by means of any system that allows said swivelling of the seat assemblies and of the flaps to be actuated in automated manner.

All in all, the installation of the invention gives rise to a number of features which are definitely advantageous, it being suitable and preferred for the application for which it is intended.

DETAILED DESCRIPTION OF THE INVENTION

Figure 1:
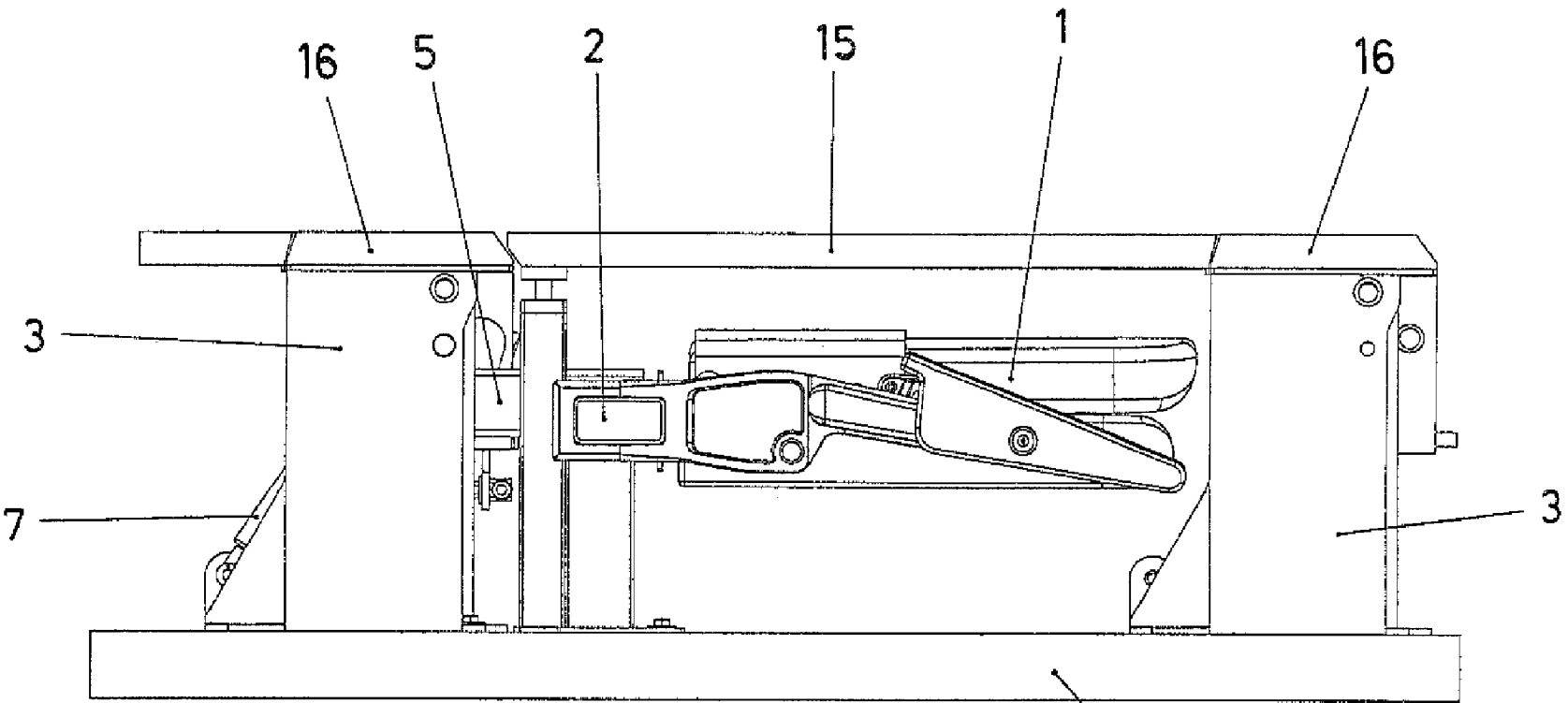
FIG. 1 is a side view of the arrangement of a group of seats in the lowered position, according to the invention.
Figure 2:
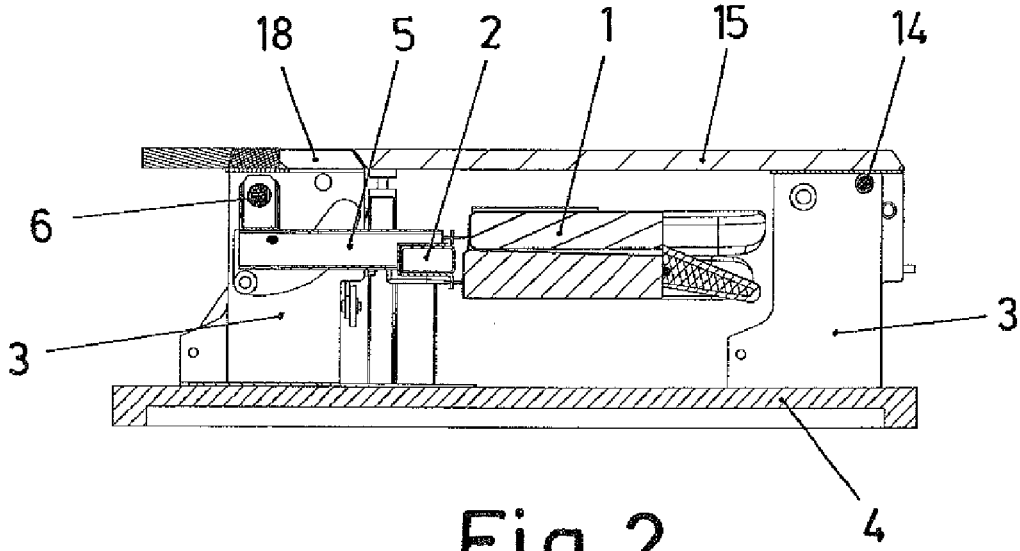
FIG. 2 is a sectional view on a smaller scale of the arrangement of the previous Figure.
Figure 3:
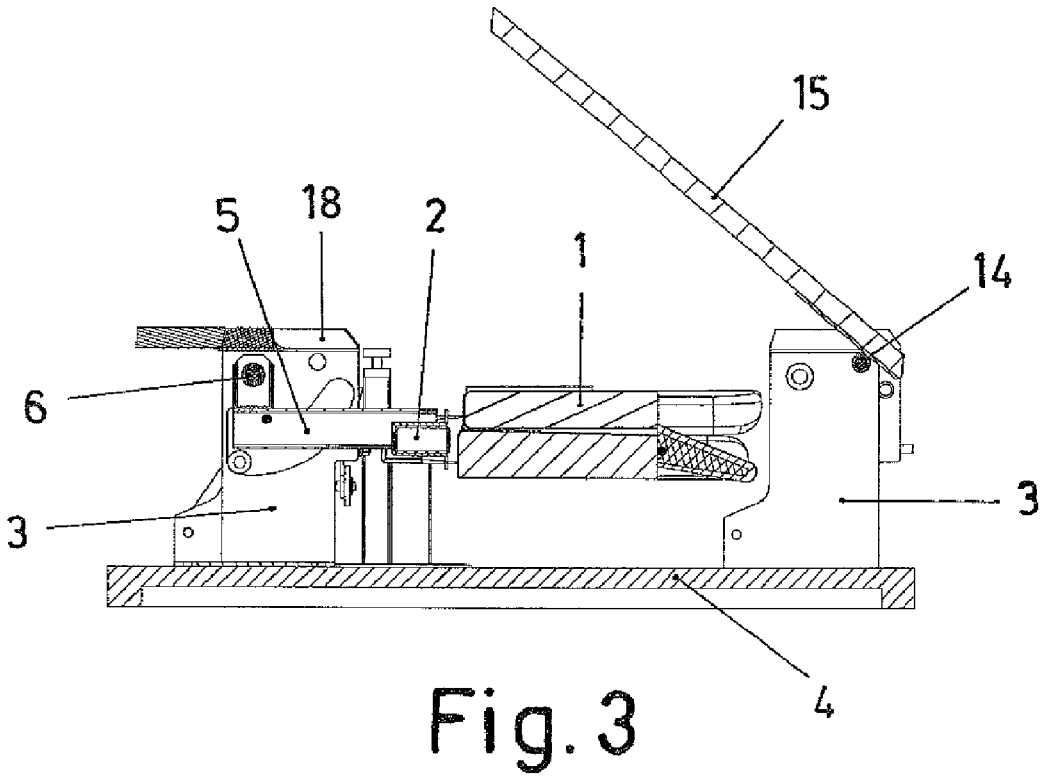
FIG. 3 is a sectional view of the same arrangement, with the covering flap partially raised.
Figure 4:
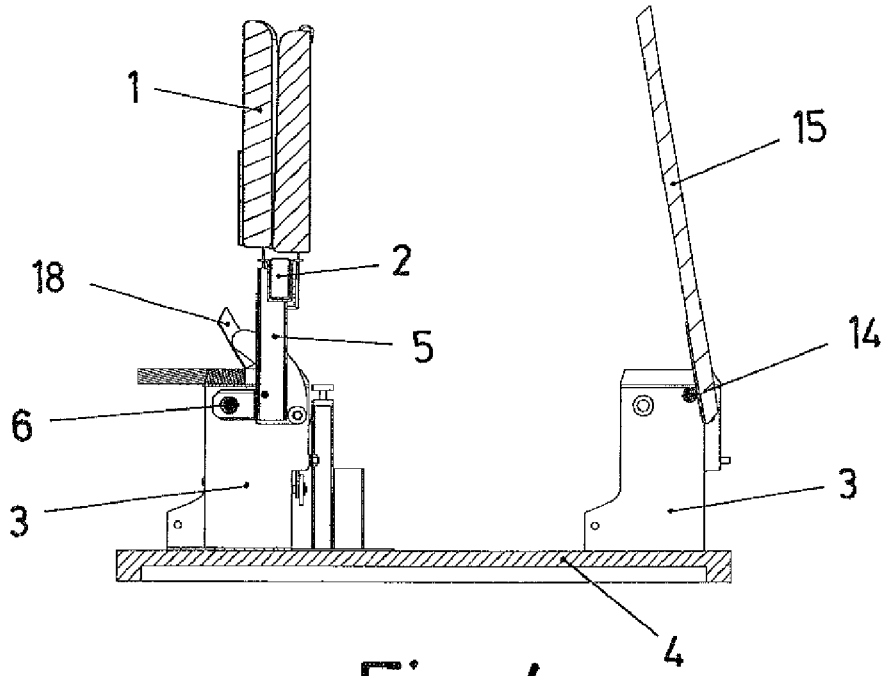
FIG. 4 is a view of the same arrangement, with the flap and the seat assembly in the raised position.
Figure 5:
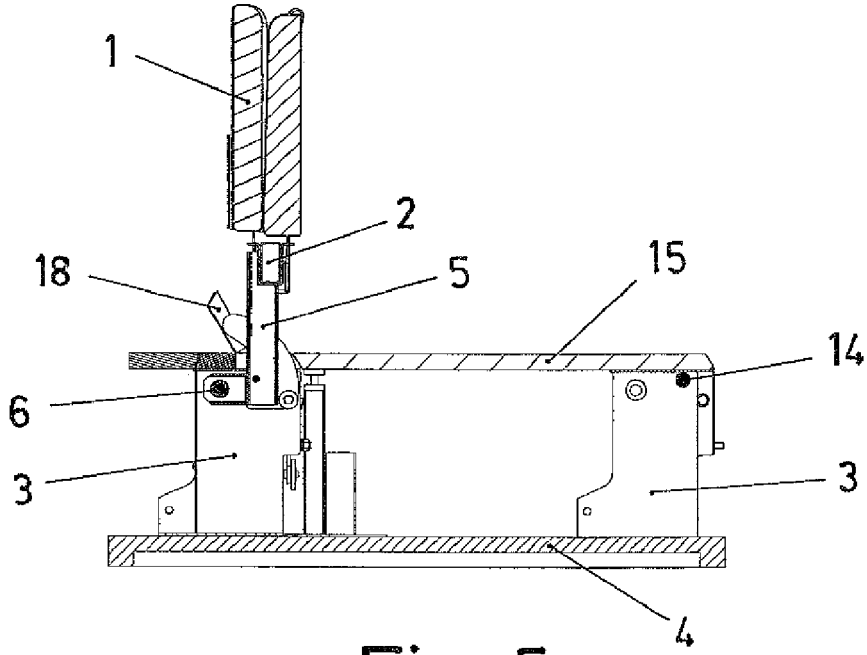
FIG. 5 is a view of the same arrangement, with the seat assembly raised and the flap lowered.

The invention provides a seating installation for enclosed spaces that require the possibility of arranging the seats in a position of use and of clearing them away such that the surface of the floor is clear, of the type that allows the seats to be concealed under a raised access floor.

In the case of the recommended installation, the seats (1) belonging thereto are arranged in assemblies of several seats (1) fitted on a structural supporting beam (2), said assemblies being mounted in articulated manner on an arrangement of low pillars (3) fixed to the base floor (4) of the relevant enclosed space.

The seat assemblies (1) are mounted on the pillars (3) by means of a number of arms (5) which are firmly connected to the structural beam (2), said arms (5) being connected to the corresponding mounting pillars (3) by means of an articulation (6).

In this arrangement, each seat assembly (1) may swivel between a lowered position and a raised position, pivoting on the articulations (6) of the arms (5) relative to the pillars (3), a number of gas cylinders (7) being provided to assist with the raising and lowering movements, these additionally cushioning the final strokes of said movements so as to prevent abrupt shocks.

Figure 9:
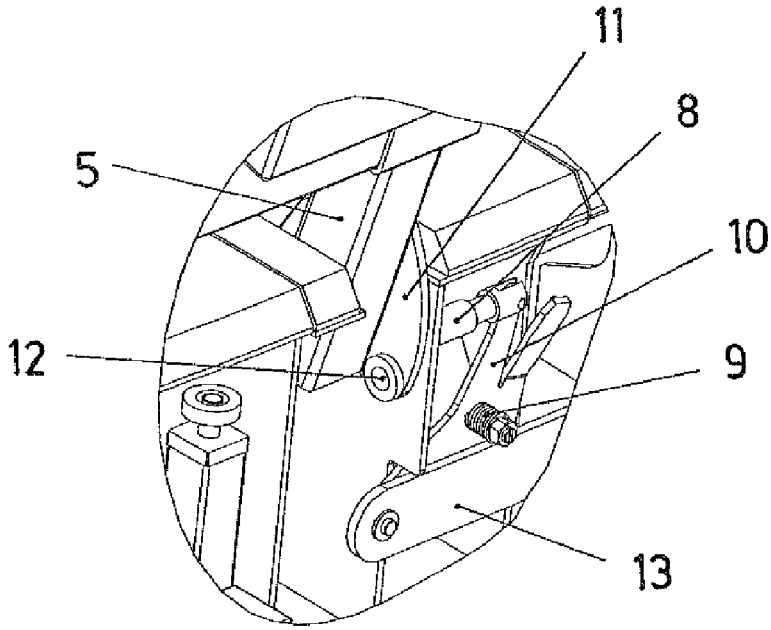
FIG. 9 shows an enlarged detail of the zone IX indicated in FIG. 7.
Figure 10:
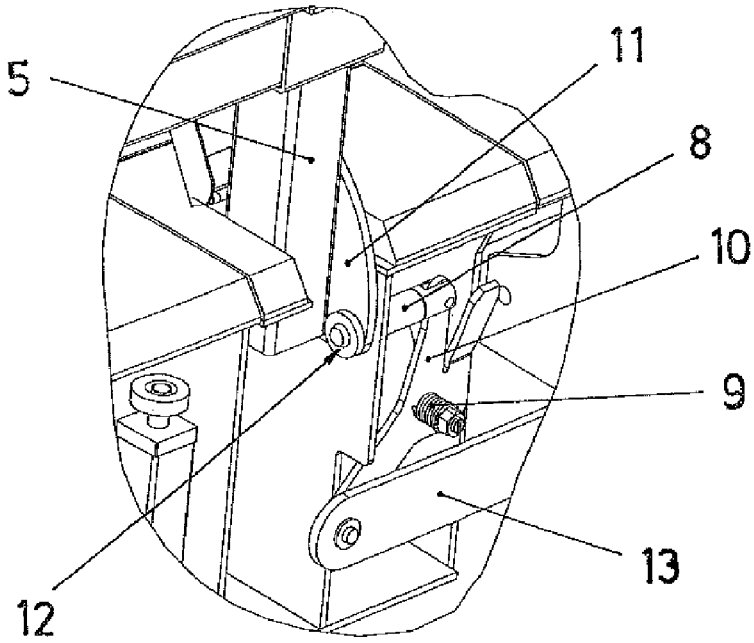
FIG. 10 shows an enlarged detail of the zone X indicated in FIG. 8.

In conjunction with this swivelling mounting of the seat assemblies (1), there are provided (FIGS. 9 and 10) a number of devices taking the form of a catch (8) which is urged to move forwards by a spring (9) via a lever (10), while, associated with the load-bearing structure of the seat assembly (1), there is provided a link (11) provided with an orifice (12) at one end, said link (11) moving together with the seat assembly (1) during the swivelling movement, such that, in the raised position of the seat assembly (1), the orifice (12) in the link (11) faces the catch (8).

In this way, when the seat assembly (1) is situated in the raised position, the catch (8) enters the orifice (12) in the link (11), so bringing about locking, which ensures that the seat assembly (1) is held in said raised position, which is the position of use, preventing said assembly from being able to swivel accidentally downwards as a result of the forces exerted on the seats (1) by users.

Through action on the lever (10), the catch (8) may move backwards, releasing the lock relative to the link (11), the result being that the corresponding seat assembly (1) becomes free and is thus able to be swivelled into the lowered position.

Each seat assembly (1) may have one or more locking devices, one locking device preferably being provided on each mounting pillar (3) so as reliably to ensure that the seat assembly is held in the raised use position. All the locking devices of each seat assembly (1) are arranged, in such a case, with their levers (10) connected by means of a bar (13), such that acting on the lever (10) of any one of the locking devices brings about actuation of all of them so as to release the seat assembly (1) in order to be able to swivel it downwards.

On the actual pillars (3) for mounting the seat assemblies (1) there are in turn mounted by means of corresponding articulations (14) a number of flaps (15), which can likewise swivel between a lowered position and a raised position.

In the lowered position, said flaps (15) form a raised access floor on the pillars (3) of the installation, underneath which are stowed the seat assemblies (1) when said assemblies are in the lowered position, such that in this position the surface of the floor of the enclosed space is totally clear.

As shown in the series of FIGS. 2 to 5, raising the flaps (15) opens up the space for stowing the corresponding seat assemblies (1), it then being possible to swivel said assemblies into the raised position for use of the seats (1), such that, when the seat assemblies (1) are in said raised position, the flaps (15) may swivel back into the lowered position, in which the floor is closed, the supports for the seat assemblies (1) projecting therethrough, said seat assemblies thus being in the position of use above the closed floor.

As is shown in the same FIGS. 2 to 5, the point of articulation (6) of the arms (5) on the pillars (3) of the installation is displaced laterally relative to the longitudinal axis of said arms (5), such that, when the seat assemblies (1) are in the lowered position, the end of the arms (5) is positioned below the respective articulation point (6), so resulting in an arrangement which allows the system to be compact, with minimal space separating the rows of seats (1) of the installation, and the seat assemblies (1) to be so situated in the lowered position that the covering raised access floor made up of the flaps (15) is positioned at a minimal height relative to the base floor (4).

Figure 6:
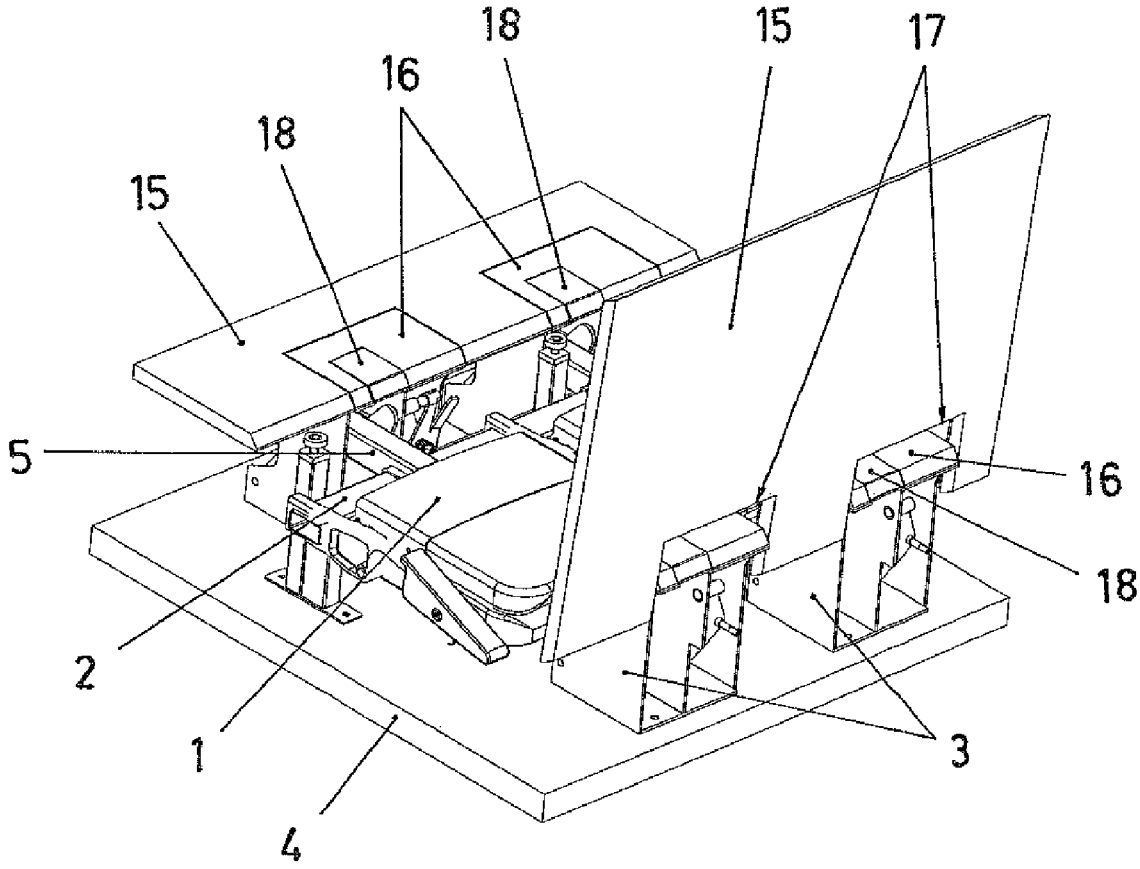
FIG. 6 is a perspective view of the assembly of the previous arrangement, with the flap raised and the seats lowered.
Figure 7:
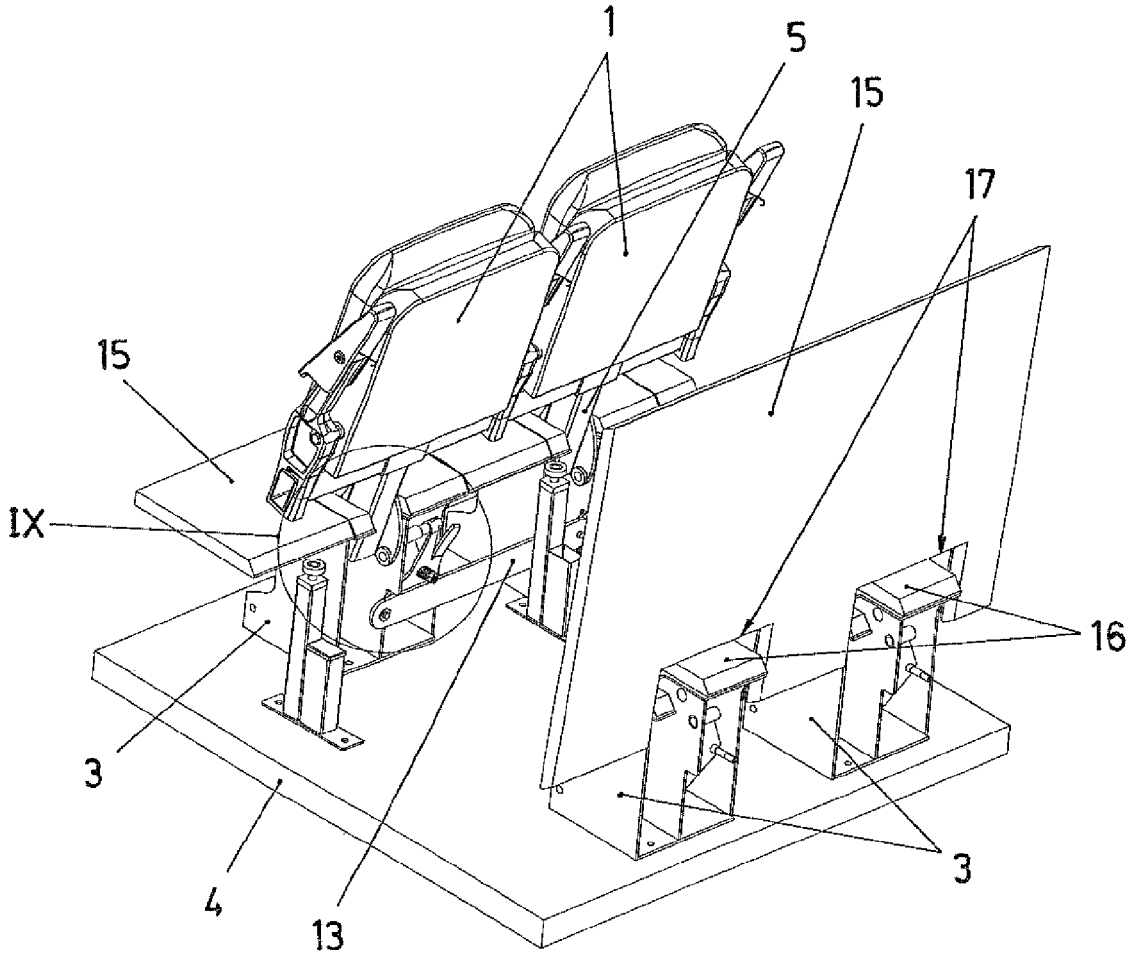
FIG. 7 is a perspective view of the previous assembly with the seats partially raised.
Figure 8:
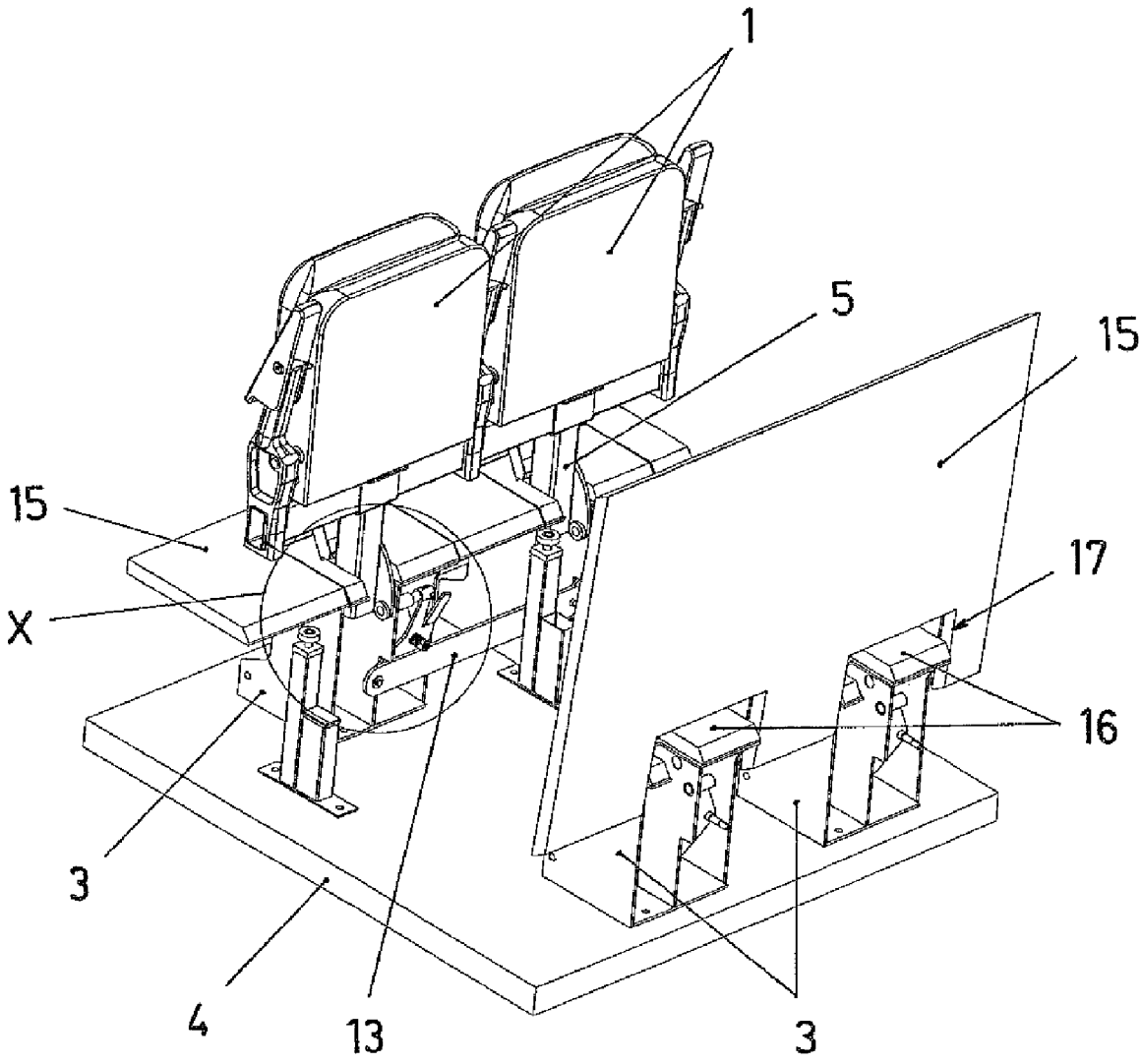
FIG. 8 is a perspective view of the same previous assembly with the flap and the seats in the raised position.

In the associated areas of the pillars (3), the flaps (15) have independent parts (16) which are fastened fixedly to the above-mentioned pillars (3), in such a way that in said areas the flaps (15) define a number of recesses (17), thanks to which the flaps (15) may swivel on the pillars (3) without obstacles arising thereon which would impede said swivelling, as may be seen from the series of FIGS. 6 to 8.

Figure 11:
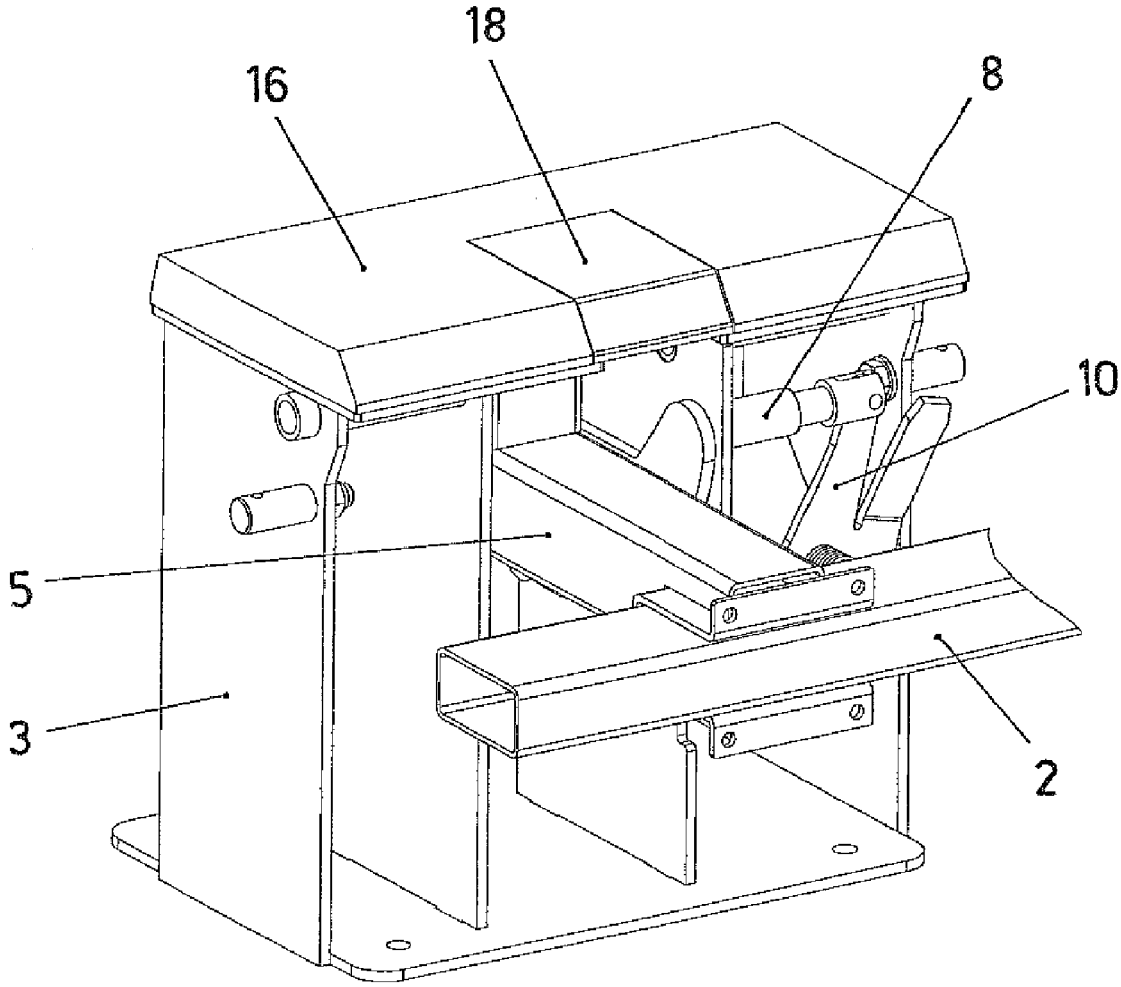
FIG. 11 is a perspective view of the articulated structure supporting seats on a pillar of the installation, with the seat support in the lowered position.
Figure 12:
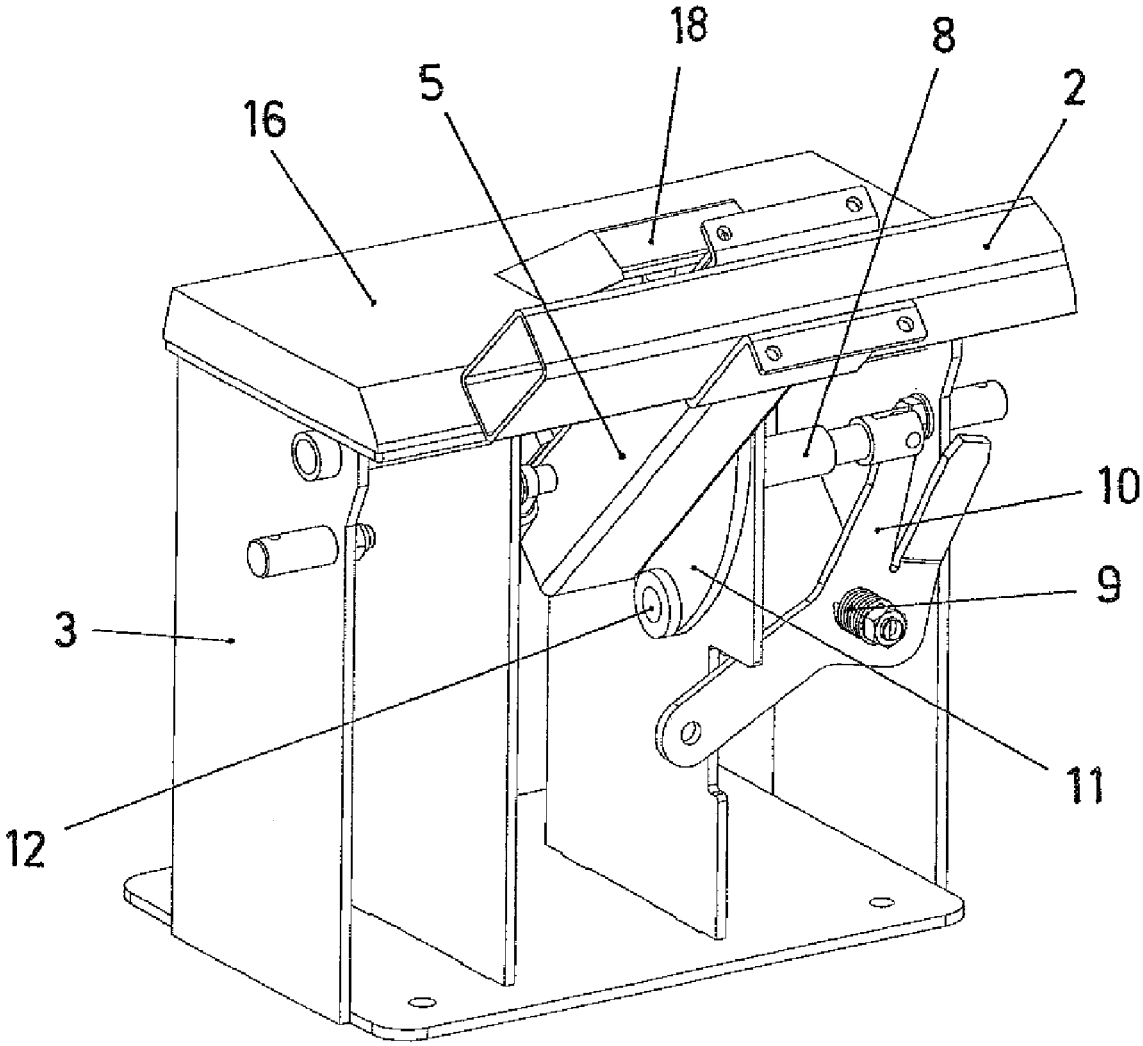
FIG. 12 is a perspective view of an assembly like the previous one, with the seat support partially raised.
Figure 13:
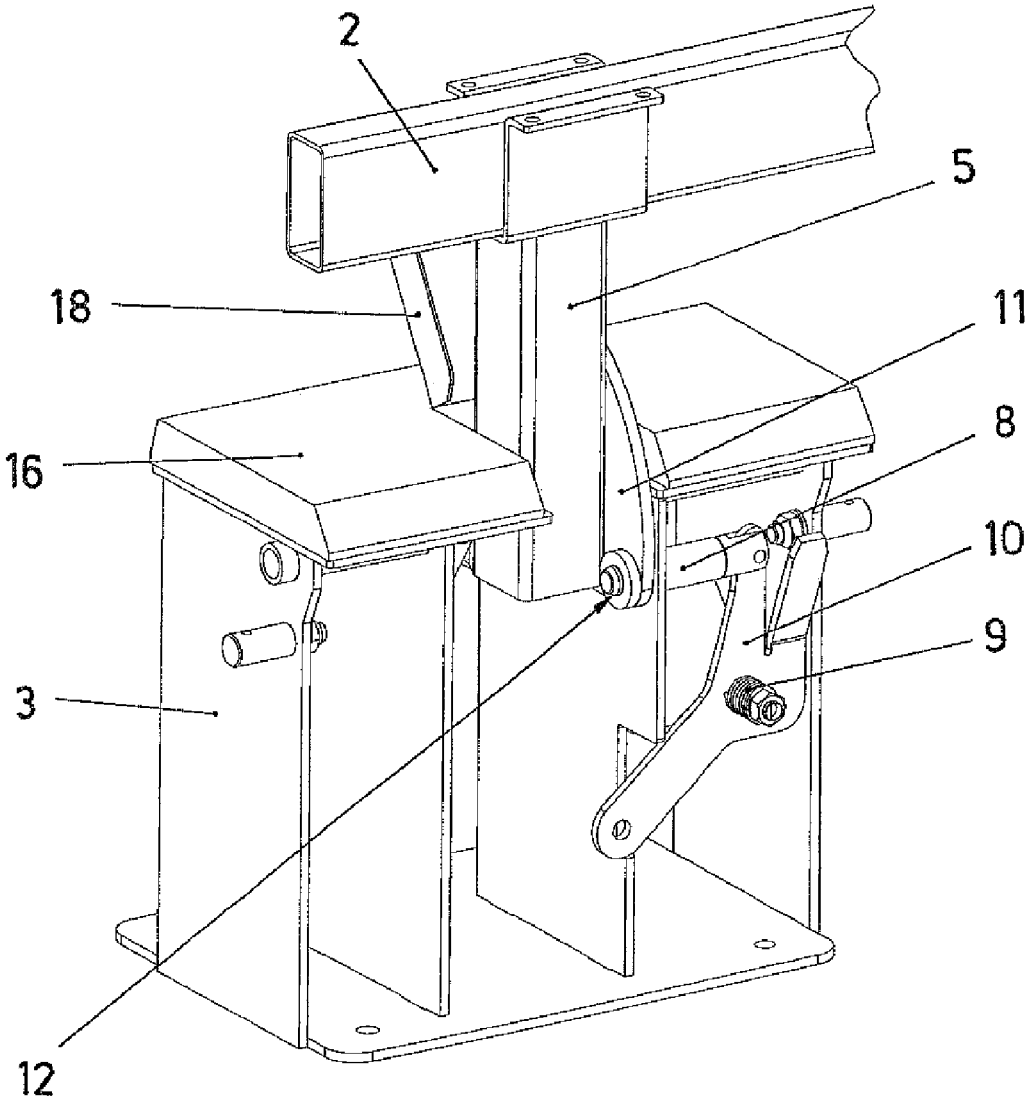
FIG. 13 is a perspective view of the same previous assembly with the seat support in the raised position.

The above-mentioned fixed parts (16) of the flaps (15) nevertheless have a number of zones (18) which are capable of swivelling, in association with the position of the arms (5) of the support structure of the seat assemblies (1), such that, when said seat assemblies (1) are swivelled into the raised position, the arms (5) force the above-mentioned zones (18) to swivel, said arms (5) thus being able to move out into the raised position as shown in the series of FIGS. 11 to 13, whereas, when the seat assemblies (1) are in the concealed position beneath the raised access floor, said zones (18) remain lowered, forming a totally closed surface of the raised access floor, as shown in FIGS. 6 and 11.

Figure 14:
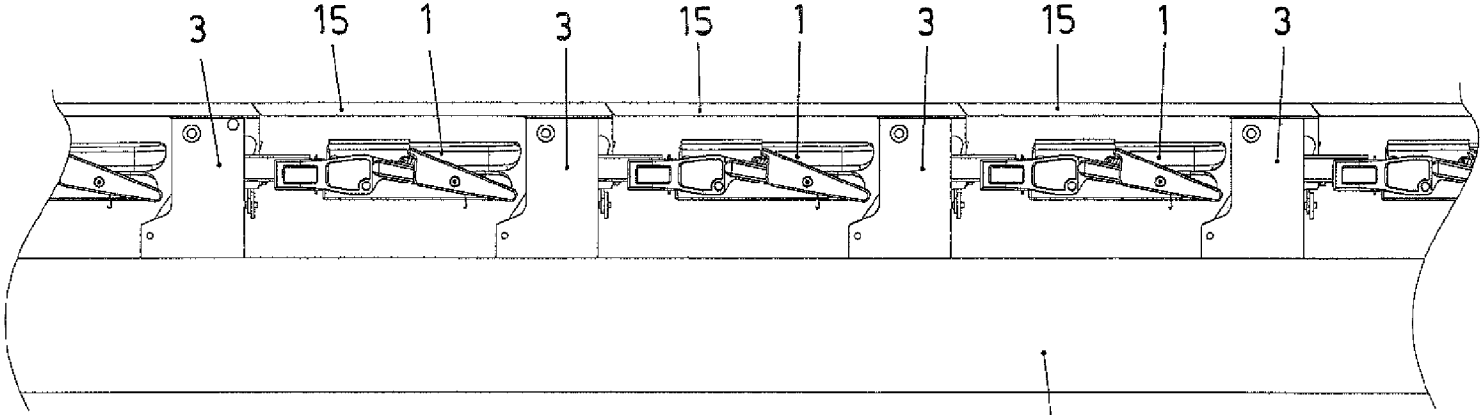
FIG. 14 is a partial view of a series of seat assemblies in an installation situated on a horizontal floor.
Figure 15:
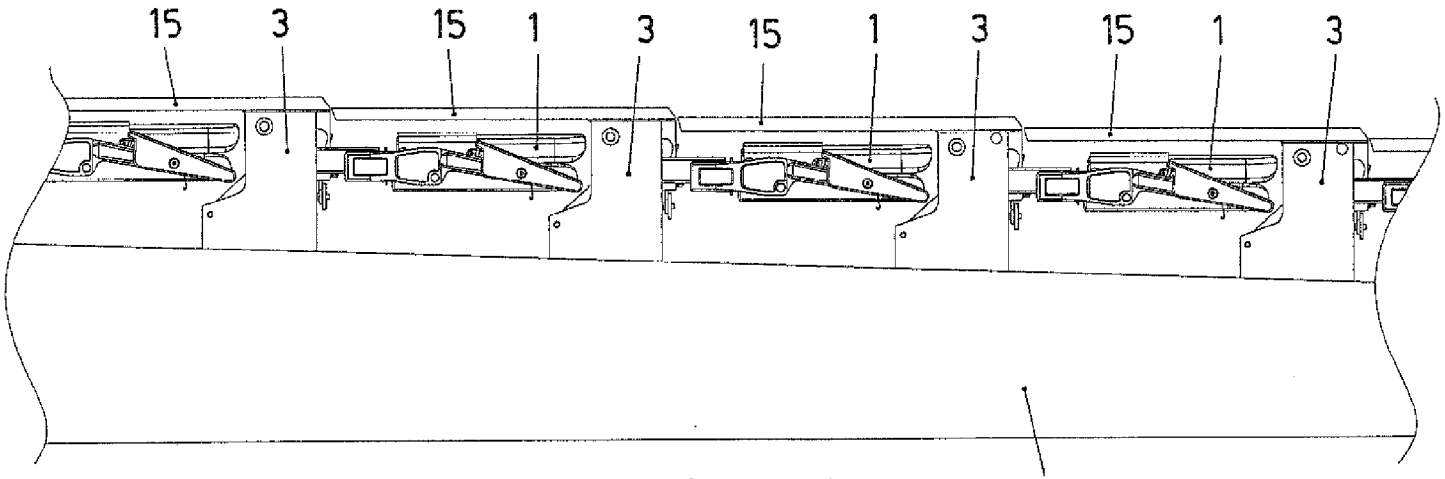
FIG. 15 is a partial view of a series of seat assemblies in an installation situated on an inclined floor.

The installation formed in this way may be arranged on a horizontal base floor (4), in which case the flaps (15) that form the raised access floor for stowing away the seat assemblies (1) therebelow form a continuous flush surface, as shown in FIG. 14; however, it is also possible, without modifying essential features, for the installation to be arranged on an inclined base floor (4), in which case the flaps (15) that form the raised access floor may define a stepped surface of horizontal sections, as shown in FIG. 15.

An embodiment is also provided in which the seat assemblies (1), together with the associated mounting pillars (3) and the respective flaps (15), take the form of modular assemblies in the manner of structural units, which facilitate mounting of the installation, since it is merely necessary to position said modular assemblies at the sites at which the installation is to be located, it being possible to incorporate the modular assemblies into raised structures so as to adapt the height of the installation as convenient, for example to form stepped tiers of seats capable of being arranged in the position of use or of being cleared away in a concealed arrangement.

In any case, the swivelling arrangement of the seat assemblies (1), as well as of the flaps (15), for movement between the respective lowered and raised positions, may be achieved by mounting with manual actuation, but an arrangement with automatic actuation may also be provided, using any motorised, pneumatic or hydraulic system, or any other currently existing system, which permits automation of said swivelling movements of the seat assemblies (1) and of the flaps (15).

The invention claimed is:

1. A seat installation comprising:

a plurality of vertical, fixed pillars mountable on a horizontal base floor in an array of horizontal rows and horizontal columns;

a plurality of folding seats, one of each of the seats rotatable mounted to one of each of the pillars, each one of the seats movable between a raised position directly above the one of the pillars on which the one of the seats is mounted and a lowered position where the one of the seats is folded and positioned horizontally between the one of the pillars on which the one of the seats is mounted and another of the pillars which is adjacent in the horizontal column; and a plurality of flaps, one of each of the flaps rotatable mounted to one of each of the pillars, each one of the flaps movable between a vertical raised position where the one of the seats moves between the raised and lowered position and a horizontally lowered position where the one of the flaps spans between the one of the pillars on which the one of the flaps is mounted and another of the pillars which is adjacent in the horizontal column thereby forming a raised floor, the raised floor adapted to be vertically above the base floor.

2. The installation of claim 1, further comprising:

a plurality of gas cylinders one of each of the cylinders fixed to one of each of the pillars to assist in the movement of the seats between the raised position and the lowered position.

3. The installation of claim 1, further comprising:

a plurality of locking devices each attached to one of each of the pillars for locking the seats in the raised position.

4. The installation of claim 1, further comprising:

a plurality of support beams, one of each of the beams extending horizontal along one of each of the horizontal rows of pillars; the plurality of seats in the one of the horizontal rows affixed to the one of the beams in the one of the horizontal rows of pillars; and a plurality of arms each of the arms rotatably mounted at one end to one of each of the pillars and fixed at the other end to the one of the support beams in the horizontal row of pillars.

5. The installation of claim 4, wherein the other end of each of the arms is vertically below the one end of each of the arms when the folding seats are in the lower position.

6. The installation of claim 1, wherein each of the flaps further comprises an independent horizontal part fixed to the top of each of the pillars and which forms part of the raised floor.

7. The installation of claim 6, wherein each independent horizontal part has a rotatable zone portion which rotates to allow for movement of the one of the seats.

* * * * *